US006422203B1

(12) United States Patent
Djordjevic

(10) Patent No.: US 6,422,203 B1
(45) Date of Patent: Jul. 23, 2002

(54) VARIABLE OUTPUT PUMP FOR GASOLINE DIRECT INJECTION

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 09/913,661

(22) PCT Filed: Feb. 17, 2000

(86) PCT No.: PCT/US00/04096

§ 371 (c)(1),
(2), (4) Date: Dec. 5, 2001

(87) PCT Pub. No.: WO00/49283

PCT Pub. Date: Aug. 24, 2000

Related U.S. Application Data

(60) Provisional application No. 60/120,546, filed on Feb. 17, 1999.

(51) Int. Cl.[7] ..... F02M 37/04
(52) U.S. Cl. ..... 123/456; 123/506
(58) Field of Search ..... 123/506, 456, 123/467, 500, 501, 446

(56) References Cited

U.S. PATENT DOCUMENTS 4,711,616 A * 12/1987 Tsukahara et al. ..... 123/506
5,197,438 A * 3/1993 Kumano et al. ..... 123/506
5,265,576 A * 11/1993 McMahon et al. ..... 123/458
5,492,099 A * 2/1996 Maddock ..... 123/446
5,526,790 A * 6/1996 Augustin et al. ..... 123/456
5,878,718 A * 3/1999 Rembold et al. ..... 123/456
6,095,118 A * 8/2000 Klinger et al. ..... 123/446
6,345,608 B1 * 2/2002 Rembold et al. ..... 123/506

* cited by examiner

*Primary Examiner*—Carl S. Miller
(74) *Attorney, Agent, or Firm*—Alix, Yale & Ristas, LLP

(57) ABSTRACT

An electronic engine management unit includes means for actuating each injector individually at a selected different time, and for a prescribed interval, during each cycle of the engine. A high pressure fuel supply pump having a high pressure discharge passage is fluidly connected to the common rail, and to a low pressure feed fuel inlet passage. A control subsystem controls the discharge pressure of the pump between injection events, by diverting the pump discharge so that instead of delivery to the common rail, the flow recirculates through the pump at a lower pressure. This is preferably accomplished by an inlet control passage fluidly connected to the low pressure feed fuel inlet passage, a discharge control passage fluidly connected to the high pressure discharge passage, and a non-return check valve in the high pressure discharge passage, between the discharge control passage and the common rail, which opens toward the common rail. A control valve is fluidly connected to the inlet control passage and to the discharge control passage, and switch means are coordinated with the means for actuating each injector. While the pump discharge passes through the control circuit but immediately before each injector actuation, the hydraulic circuit is substantially closed whereby the pump output pressure rises from the holding pressure to the high pressure. When the pump output pressure reaches the high pressure an injector is actuated.

23 Claims, 12 Drawing Sheets

VARIABLE OUTPUT PUMP FOR GASOLINE DIRECT INJECTION

This application was filed under 35 USC §371 based on international application No. PCT/US00/04096, which claims benefit under 35 USC §119 (e) of U.S. Pat. No. 60/120,546, filed Feb. 17, 1999.

BACKGROUND OF THE INVENTION

The present invention relates to fuel pumps, particularly of the type for supplying fuel at high pressure for injection into an internal combustion engine.

Typical gasoline direct injection systems operate at substantially lower pressure level when compared, for example, to IDI or DI diesel fuel injection systems. The amount of energy needed to actuate the high-pressure pump is insignificant in the total energy balance. However, in a system with a constant output pump and variable fuel demands all of the unused pressurized fuel has to be returned into the low-pressure circuit. A good portion of the energy originally used to pressurize the fuel is then converted into thermal energy and has to be dissipated. Even a relatively modest heat rejection (200–500 Watt) will result in fuel temperature increase (especially if the fuel tank is only partially full) and this will further worsen already serious problems resulting from low vapor pressure of a typical gasoline fuel. Because of that a variable output high-pressure supply pump would be very desirable.

Furthermore, a speed range of a typical gasoline engine is substantially wider than that of diesel engines (e.g., from 500 RPM at idle to 7000 RPM or higher at rated speed). With variable pumping pressure it would be easier to optimize the injection rate at any engine speed.

Several configurations for a direct injection gasoline supply pump are shown and described in U.S. patent application Ser. No. 09/031,859, filed Feb. 27, 1998 for "Supply Pump For Gasoline Common Rail", the disclosure of which is hereby incorporated by reference. The present invention can be considered as particularly well suited for implementation in one or more of the embodiments shown in said application, as well as variations thereof.

SUMMARY OF THE INVENTION

According to the present invention, a high pressure pump provides both variable output and pumping pressure modulation. At a first level of control (gross modulation), the pump does not undergo high pressure pumping action, except when needed. At a secondary level of control (micromodulation), at least the frequency of actuation of an electrically operated, (e.g., proportional solenoid), is manifested as pumping pulses which produce the required average high pressure.

The invention can broadly be considered as a method for controlling a common rail gasoline fuel injection system having a high pressure supply pump to the common rail, wherein the improvement comprises recycling the pump discharge flow through the pump at a pressure lower than the rail pressure, between injection events, and restoring the discharge flow to the common rail immediately before the next injection event.

The invention may be better understood in the context of a gasoline fuel injection system for an internal combustion engine, having a plurality of injectors for delivering fuel to a respective plurality of engine cylinders and a common rail conduit in fluid communication with all the injectors for exposing all the injectors to the same supply of high pressure fuel. An electronic engine management unit includes means for actuating each injector individually at a selected different time, and for a prescribed interval, during each cycle of the engine. A high pressure fuel supply pump having a high pressure discharge passage is fluidly connected to the common rail, and to a low pressure feed fuel inlet passage. A control subsystem controls the discharge pressure of the pump between injection events, by diverting the pump discharge so that instead of delivery to the common rail, the flow recirculates through the pump at a lower pressure. This is preferably accomplished by an inlet control passage fluidly connected to the low pressure feed fuel inlet passage, a discharge control passage fluidly connected to the high pressure discharge passage, and a non-return check valve in the high pressure discharge passage, between the discharge control passage and the common rail, which opens toward the common rail. A control valve is fluidly connected to the inlet control passage and to the discharge control passage, and switch means are coordinated with the means for actuating each injector, for controlling the control valve between a substantially closed position for substantially isolating the inlet control passage from the discharge control passage and a substantially open position for exposing the inlet control passage to the discharge control passage.

The invention may also be considered a method for controlling the operation of a high pressure common rail direct gasoline injection system for an internal combustion engine, comprising continuously operating a high pressure fuel pump to receive feed fuel at a low pressure and discharge fuel at a high pressure to a check valve which opens to deliver high pressure fuel to the common rail. Sequentially, each injector is actuated, and after each injector actuation, an hydraulic control circuit is opened upstream of the check valve, whereby the pump discharge passes through the control circuit instead of the check valve, at a decreased pressure from the high pressure to a holding pressure between the high pressure and the feed pressure. While the pump discharge passes through the control circuit but immediately before each injector actuation, the hydraulic circuit is substantially closed whereby the pump output pressure rises from the holding pressure to the high pressure. When the pump output pressure reaches the high pressure an injector is actuated.

BRIEF DESCRIPTION OF THE DRAWINGS

The preferred embodiments of the invention will be described below with reference to the accompanying drawings, in which.

DESCRIPTION OF THE PREFERRED EMBODIMENTS

Figure 1:
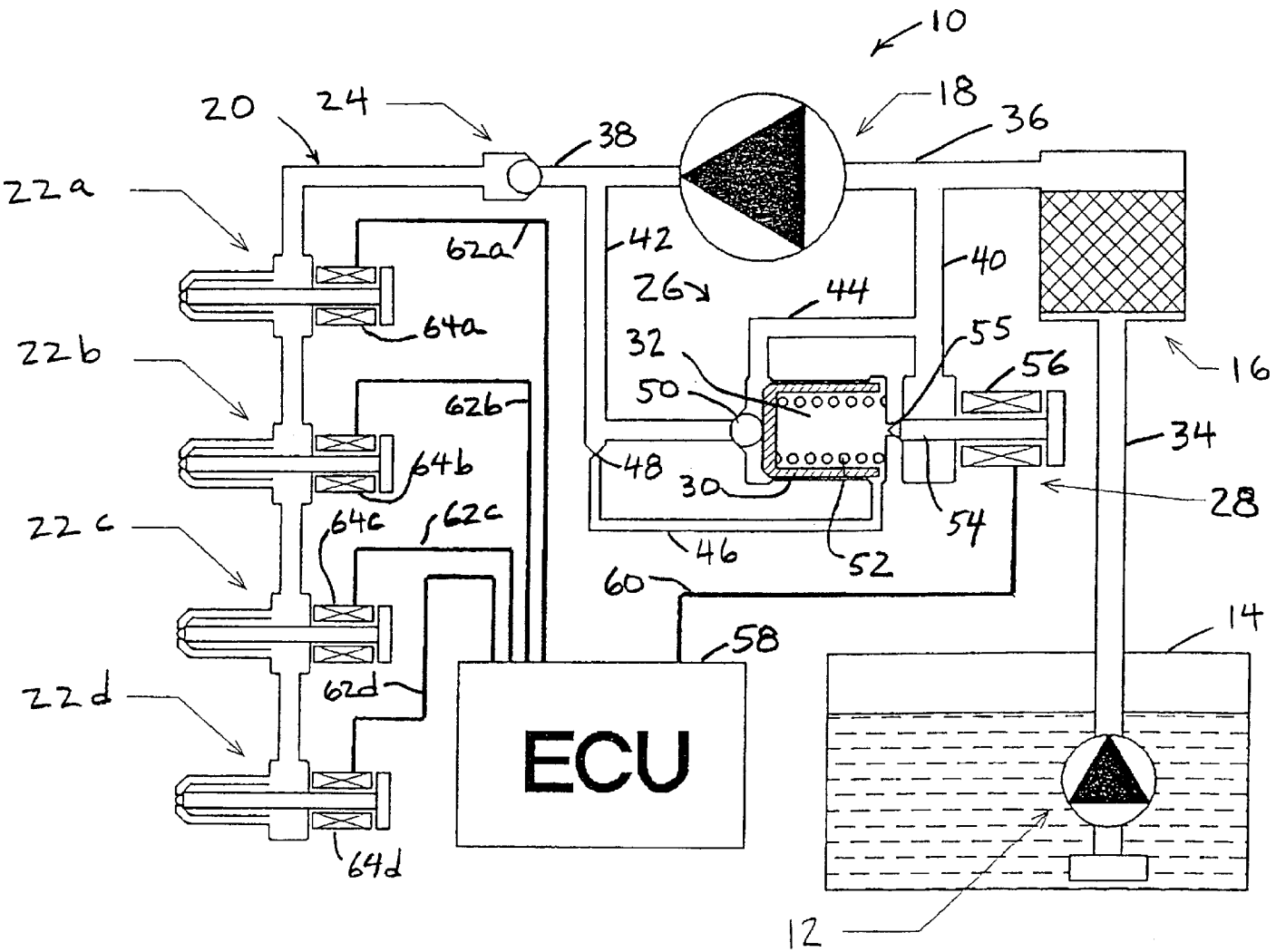
FIG. 1 is a schematic of a first embodiment of a gasoline direct injection system according to the invention.

According to the schematic shown in FIG. 1, gasoline is supplied, via feed line 34 and fuel filter 16, by an electric feed pump 12 at relatively low pressure (under 5 bar, typically 2–4 bar) from the fuel tank 14 to the high-pressure fuel supply pump 18. From the high-pressure pump 18 gasoline is supplied to the common rail 20 and from the rail 20 to the individual injectors 22*a*–22*d*. According to the invention, a control valve 28 in a internal hydraulic circuit 26, controls the instantaneous discharge pressure of the pump 18, by diverting and modulating the pressure of the pump discharge flow.

In the embodiment of the hydraulic circuit 26 shown in FIG. 1, piston 30 and associated spring 52 provide a bias on ball 50, thereby blocking flow between pump inlet passage 36, inlet control passage 40, and first branch passage 44 on the one hand, and pump discharge passage 38 and discharge control passage 42 on the other hand. An orifice 48 provides fluid communication from the discharge control passage 42 to second branch passage 46, which is in fluid communication with control chamber 32 within piston 30. The valve 28, preferably a proportional control valve, has a valve member 54 having a valve surface which bears against valve seat 55 when the valve is fully closed. With the preferred solenoid type valve operator 56, the valve member 54 is normally open but closes upon energizing of the solenoid. The timing and duration of solenoid energization, is controlled by the engine management system (e.g., electronic control unit, ECU 58), via signal path 60. Such control includes the distance by which the valve member 54 shifts toward and away from the seat 55 (i.e., the valve stroke), which is adjustable when a proportional control valve is employed.

The ECU 58 also controls the solenoids 64*a*–64*d* associated respectively with the injectors 22*a*–22*d*, via signal lines 62*a*–62*d*. Each injection event is controlled at least as to start and duration.

Figure 2:
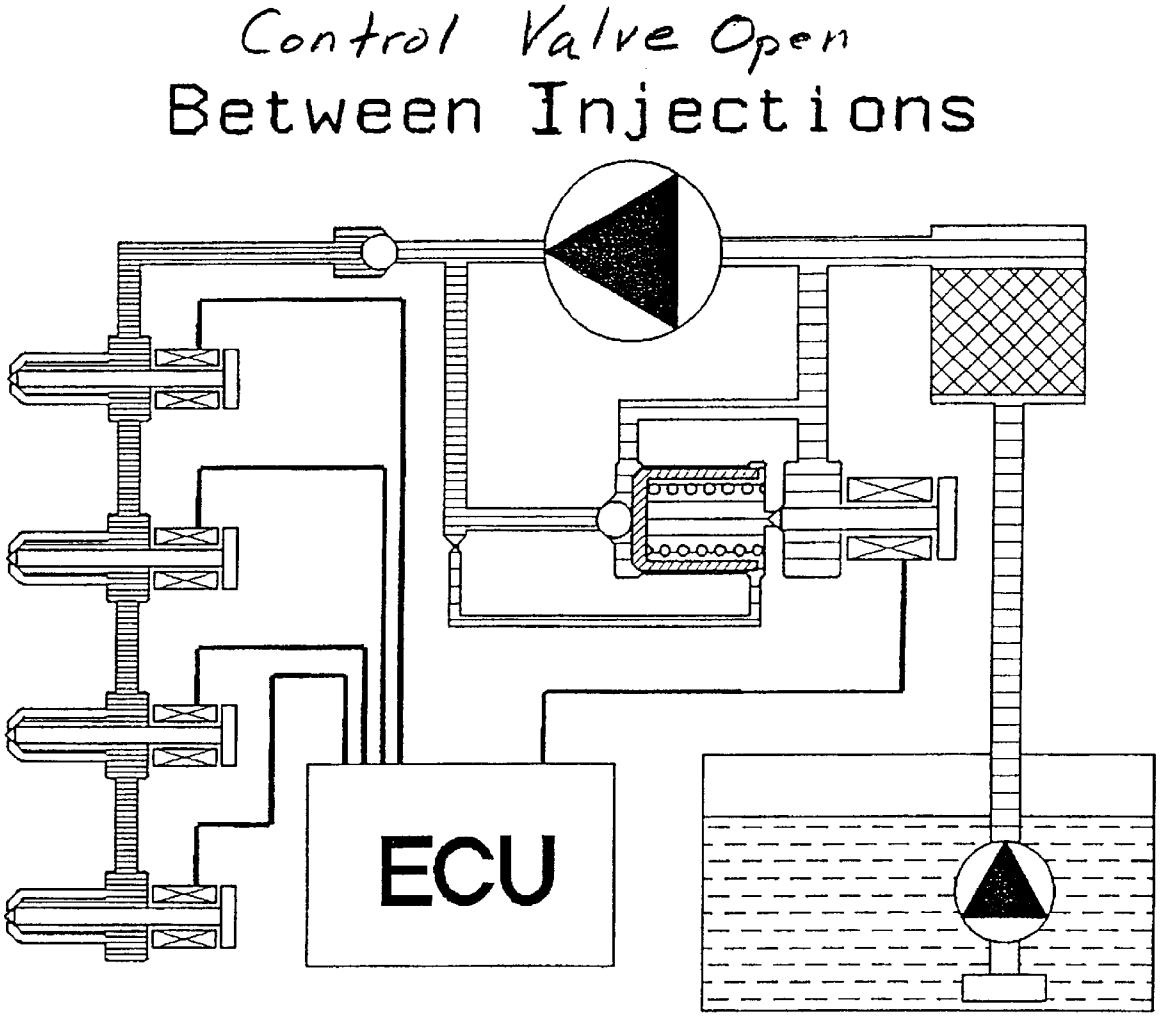
FIG. 2 is a schematic of the embodiment of FIG. 1, between injection events.
Figure 3:
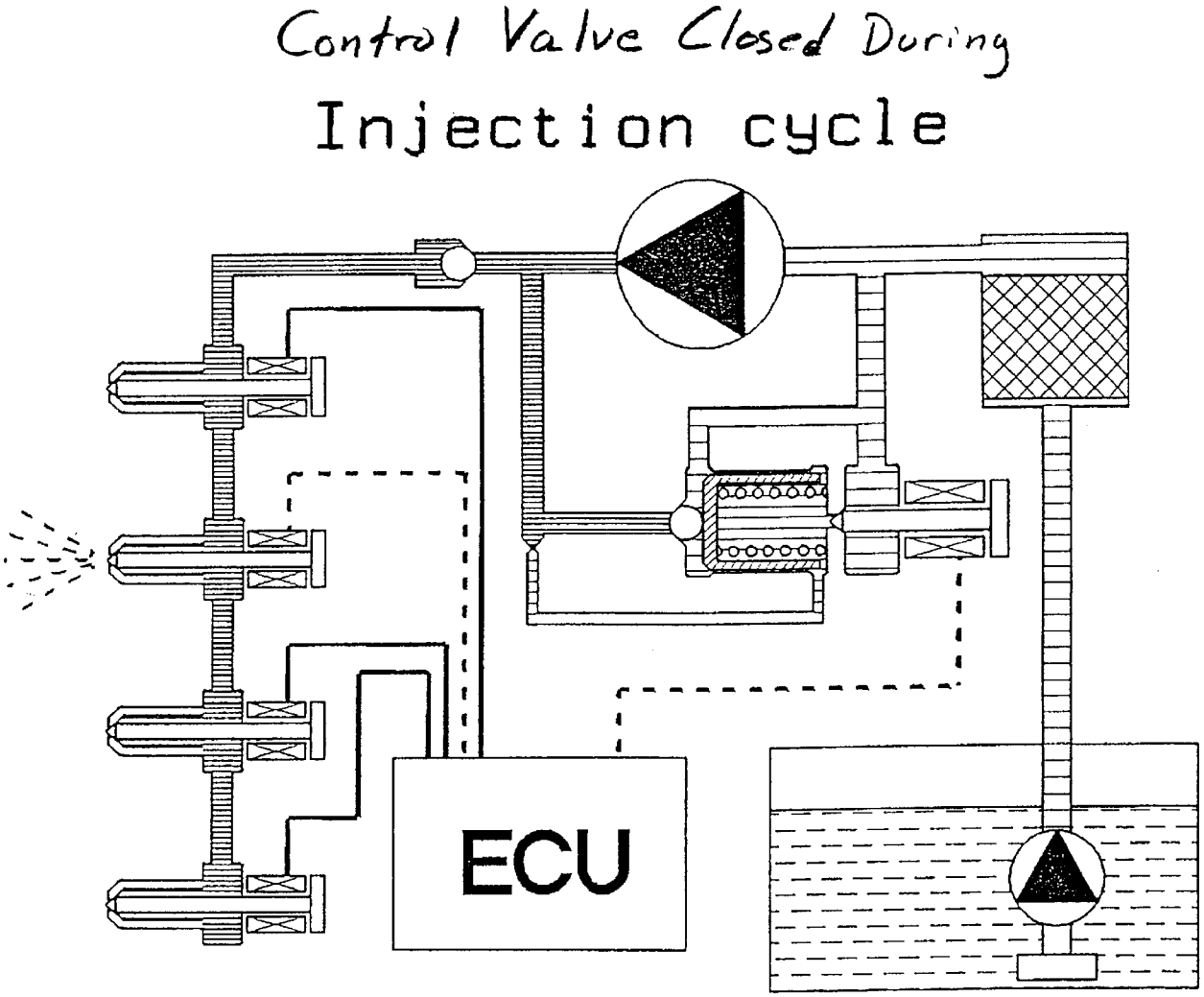
FIG. 3 is a schematic of the embodiment of FIG. 1, during an injection event.

Between the injection events the proportional solenoid valve is substantially open (either completely denergized or at some reduced duty cycle). The pressure in the control chamber 32 will be low and all the fuel displaced by the high pressure pump will be internally recycled through the pump at some reduced pressure level above the feed pressure but below the high pressure for discharge to the rail. In the embodiment of FIG. 1, this holding pressure between injection events will depend mainly on the piston return spring 52 preload and the back pressure in the control chamber. The low pressure of the feed fuel is less than about 5 bar, the high pressure during steady state operation is greater than about 100 bar, and the holding pressure is preferably in the range of about 10–30 bar. These three pressure regions can be discerned in FIG. 2 from the three different line densities in the various flow passages.

The substantial closing and substantial opening of the valve increases flow resistance and decreases flow resistance, respectively, of the fuel passing through the control circuit along the valve seat. The flow resistance is controlled by varying at least one of the spacing of the valve member 54 from the valve seat 55 and the frequency of changes in the spacing. When the valve is substantially closed, the space is eliminated so that flow resistance is essentially infinite and no flow passes along the seat. When the valve is substantially closed, a non-zero minimum space is maintained, providing a higher resistance than the rest of the control circuit but permitting a low flow passing along the seat.

It should also be appreciated that the piston in the circuit 26 of FIG. 1 is optional, but it acts as a minimum pressure regulator, providing positive torque and "limp home" pressure for the common rail.

Figure 4:
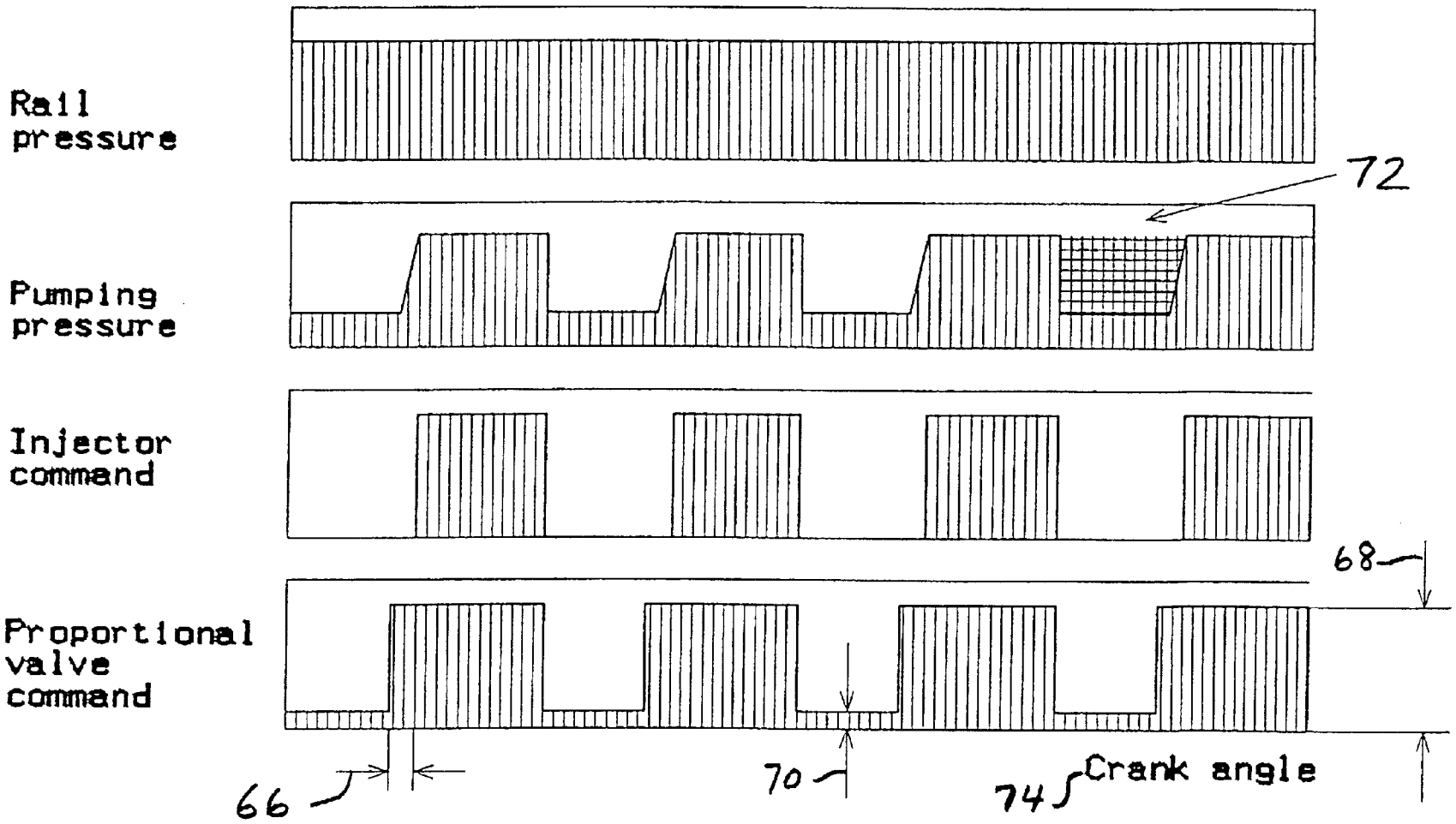
FIG. 4 is a diagrammatic representation of the behavior of the rail pressure, pumping pressure, injector command signal, and proportional control valve signal associated with a first control method for the system of FIG. 1, according to the invention.

FIGS. 4 shows the behavior of the rail pressure, supply pump discharge pressure, fuel injector actuation or commend signal, and proportional control valve energizing or commend signal, along a scale corresponding to engine rotation or crank angle 74, during steady state operation of the system shown in FIG. 1. Shortly before the desired start of injection (see phase shift 66) the duty cycle 68 of the proportional solenoid valve is increased above a base or minimum level 70, substantially closing the valve member. The pressure in the piston control chamber 32 will increase as more fuel is supplied through the control orifice 48 than the amount of fuel leaving the control chamber 32 along the proportional valve seat 55. The pressure increase will be gradual because some small amount of fuel is needed to displace the piston and to close or restrict the flow through the proportional valve. Shortly after the desired high pressure level for the rail is reached, any of the injectors, such as 22*b*, is switched on and gasoline is delivered into the designated engine cylinder. At the end of the injection event the injector solenoid 64*b* and the proportional valve solenoid 56 are switched off simultaneously and the pumping pressure will be reduced accordingly.

Figure 5:
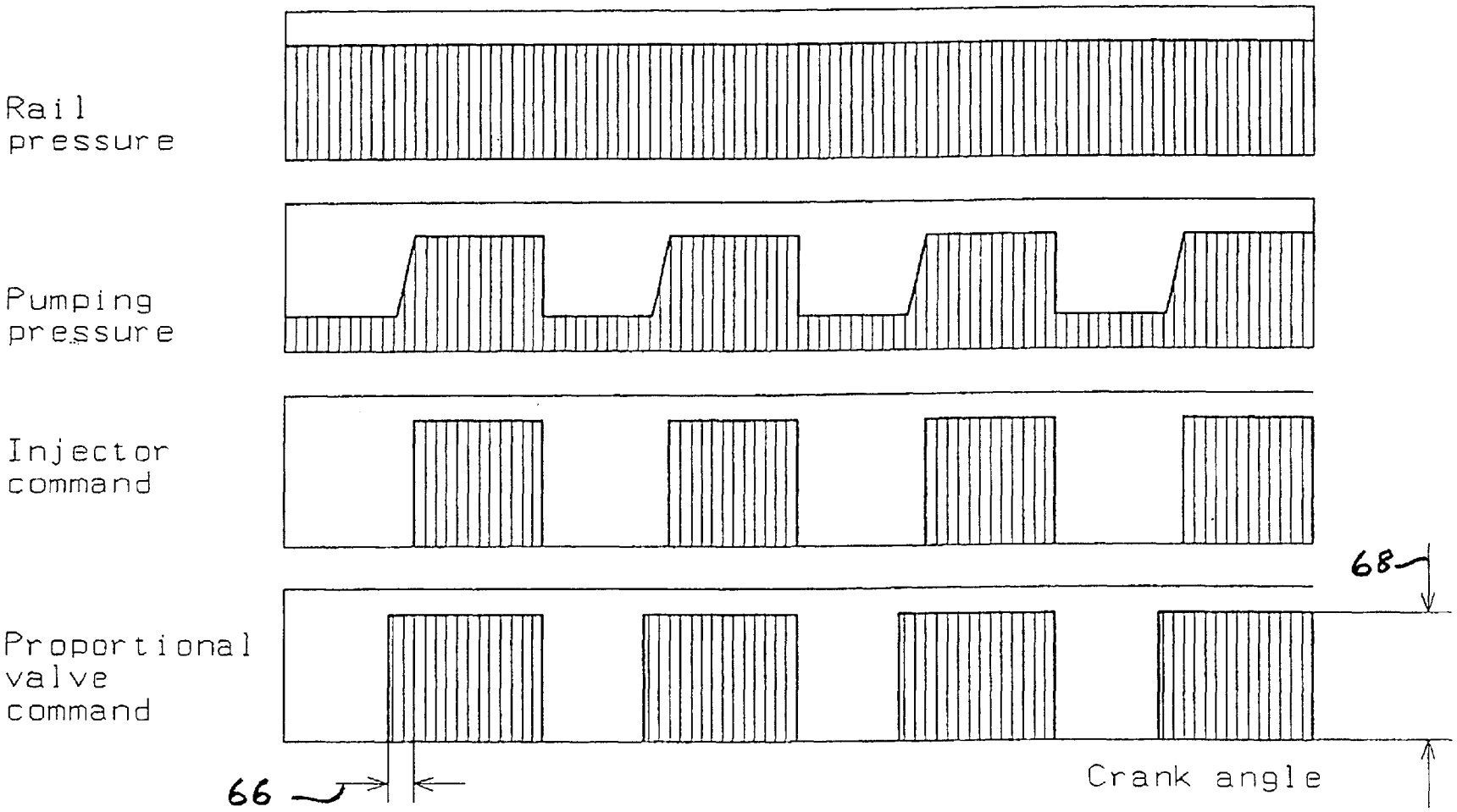
FIG. 5 is a diagrammatic representation of the behavior of the rail pressure, pumping pressure, injector command signal, and proportional control valve signal associated with a second control method for the system of FIG. 1, according to the invention.

FIG. 4 shows the control embodiment wherein the solenoid valve 56 is not fully closed at the end of injection, but is maintained at a low duty cycle to help establish the subsequent holding pressure. FIG. 5 shows another embodiment wherein the solenoid is completely deenergized at the end of the injection event.

In both FIGS. 4 and 5 it can be seen that the control valve begins shifting from the substantially open to the substantially closed condition before actuation of an injector, the control valve remains in the substantially closed condition during actuation of that injector, and the control valve returns to and remains in the substantially open condition simultaneously with the deenergizing of that injector. During steady state operation above idle speed of the engine, the injections are discrete events each beginning on a regular time interval, each event having the same duration which is no greater than about one-half the regular time interval. Each injection event has a unique holding pressure interval and control valve actuation event associated therewith, and each injection event has a unique high pressure pumping duration associated therewith. Each control valve actuation event and each high pressure pumping duration has a longer duration than the associated injection event. The injection event, the control valve actuation, and the high pressure pumping duration, all terminate substantially simultaneously.

Because the high pressure pump 18 and the rail 20 are separated by a non-return check valve 24 and because there is no demand for fuel between the injection events, the pressure in the rail will remain more or less constant. The rail, however, does not have capacity to store any significant amount of fuel. Even if the desired pressure was reduced in the mean time, the pressure will drop instantly as soon as the injector opens and the injection will take place at a lower pressure level, determined by a reduced pressure in the control chamber of the intensifier piston. The main advantage of the present invention is that there is always some minimum pumping pressure between the injection events, and the pressure prior to the injection increases gradually. As a result, there will be no torque reversals or zero crossings. Therefore, the pump operation will be very smooth and quiet.

Although the proportional solenoid valve 28 response is relatively slow, this can be compensated for by selection of proper phase shift 66 and of the actuating frequency of the valve member 54. Even with a relatively long phase shift there will always be some net energy savings, as is indicated at 72. Proportional solenoid valves are relatively inexpensive and can be exactly controlled in open mode.

Figure 6:
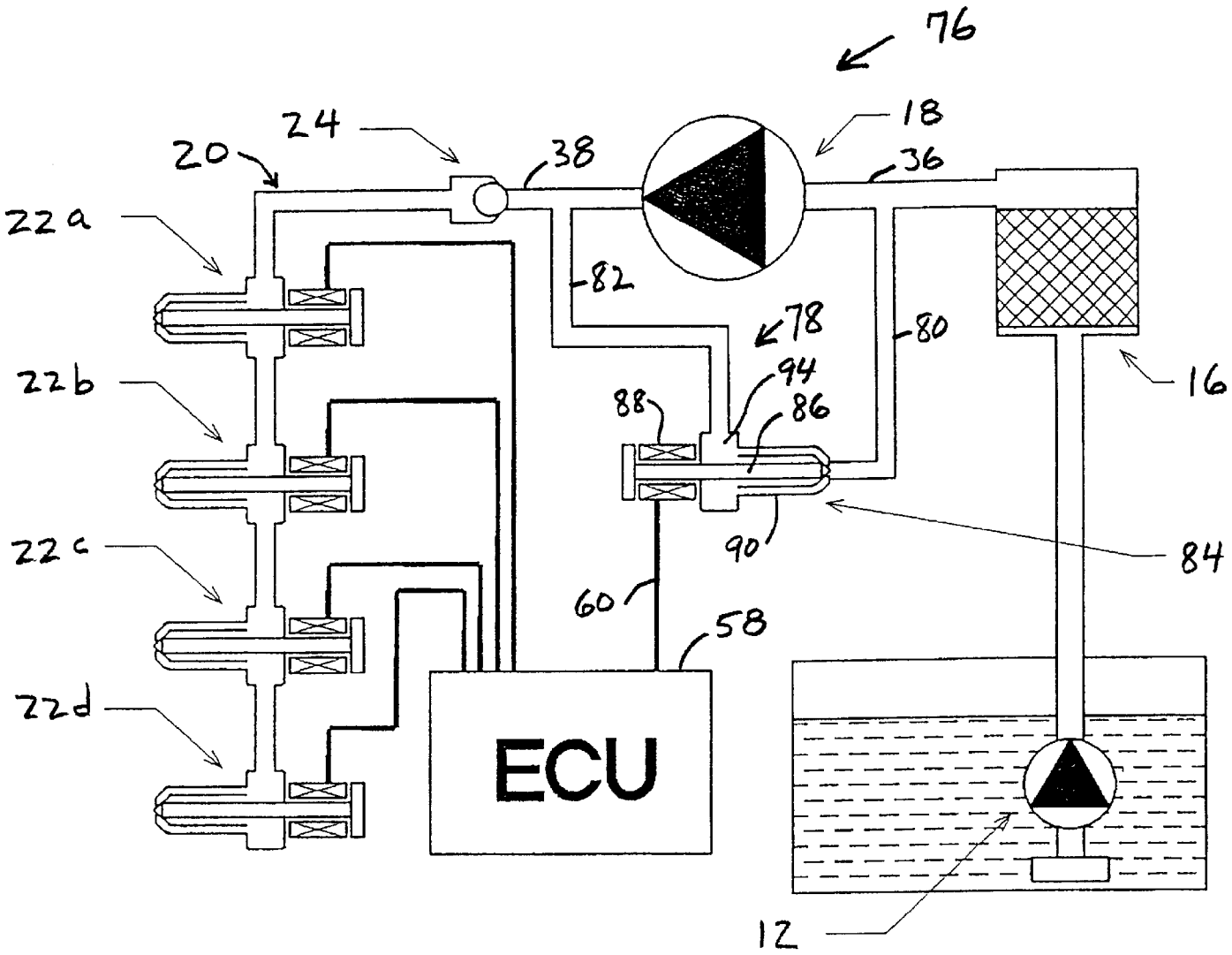
FIG. 6 is a schematic of a second embodiment of a gasoline direct injection system according to the invention.

As shown in the system 76 FIG. 6, if a faster responding hydraulic circuit 78 is desired, an injector (externally) or an injector-like fast solenoid switching valve (internally) 84 can be used as a substitute for valve 28 of FIG. 1. Such valve 84 has a hollow body 90 in fluid communication as by annular chamber 94 with one of the inlet control passage 80 or the discharge control passage 82, a hole 92 in the body, a needle valve member 86 shiftable within the body to open or close the hole as the solenoid 88 operates, and the other of the inlet control passage or the discharge control passage being exposed to the hole. The reduced pressure between the injection events will then depend either from the pressure drop across the switching valve or from a pressure limiting valve which can be installed in series down stream from the switching valve (not shown).

Figure 7:
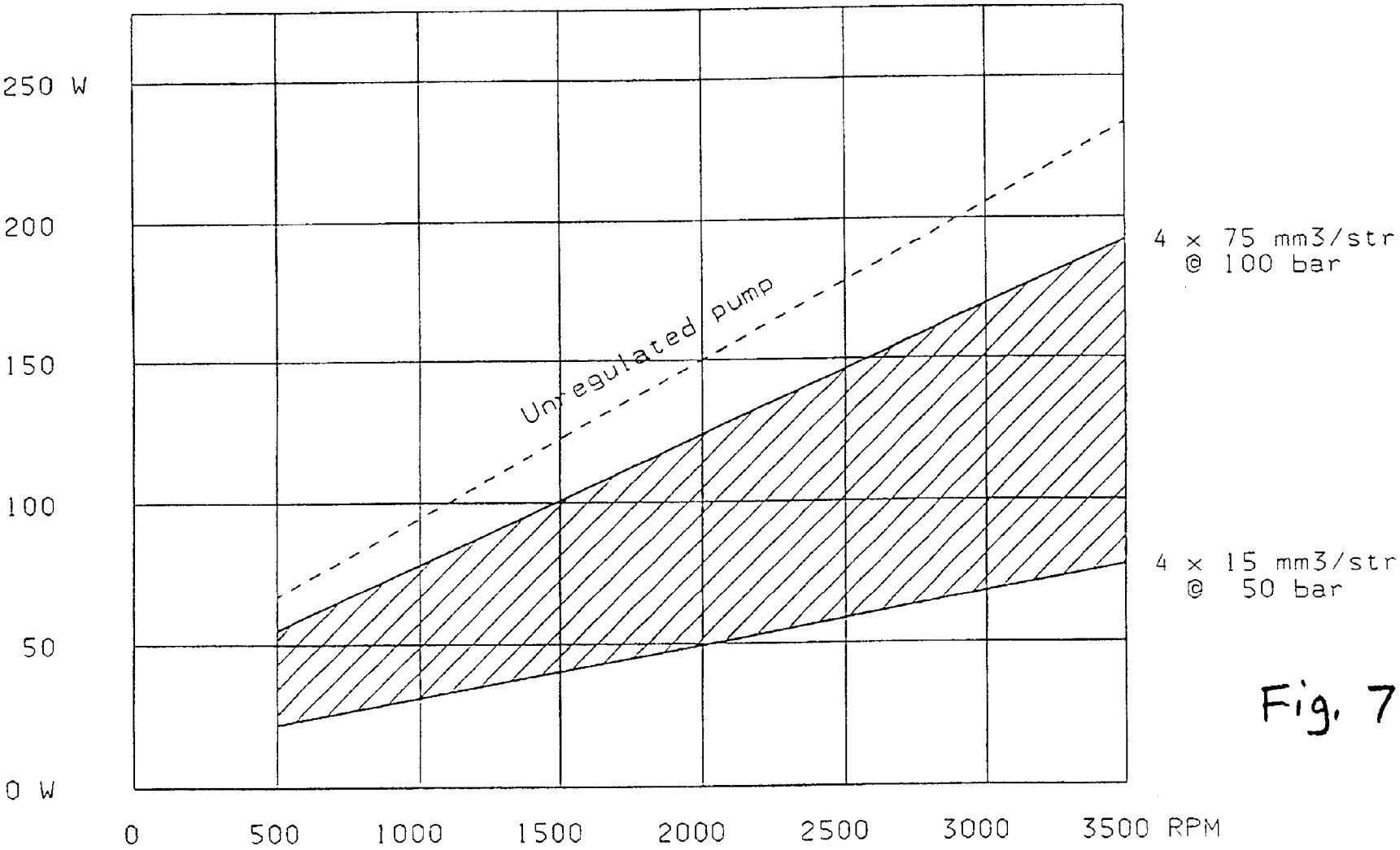
FIG. 7 is a graphical representation of the theoretical power requirement utilizing the variable delivery and injection pressure of the invention relative to an unregulated pump.

FIG. 7 shows an example of power requirements of unregulated versus modulated pump according to the invention. Although theoretical energy saving as shown in FIG. 7 may be diminished because some power is required to operate the solenoid valve, there still will be net positive energy gain. More important, the energy used to operate the solenoid only insignificantly increases gasoline temperature. This is a main objective of this invention, because it allows operation without low pressure fuel return and/or without need for a fuel cooler. If output modulation is required, there will always be energy losses, based on fuel flow and force (pressure) level, regardless of what control system (pressure regulating valve, solenoid spill valve in the rail, mechanism changing the eccentricity etc.) is used. One exception is inlet metering, but this system seems to be too inaccurate, too slow and it generates a lot of acoustic noise.

Figure 8:
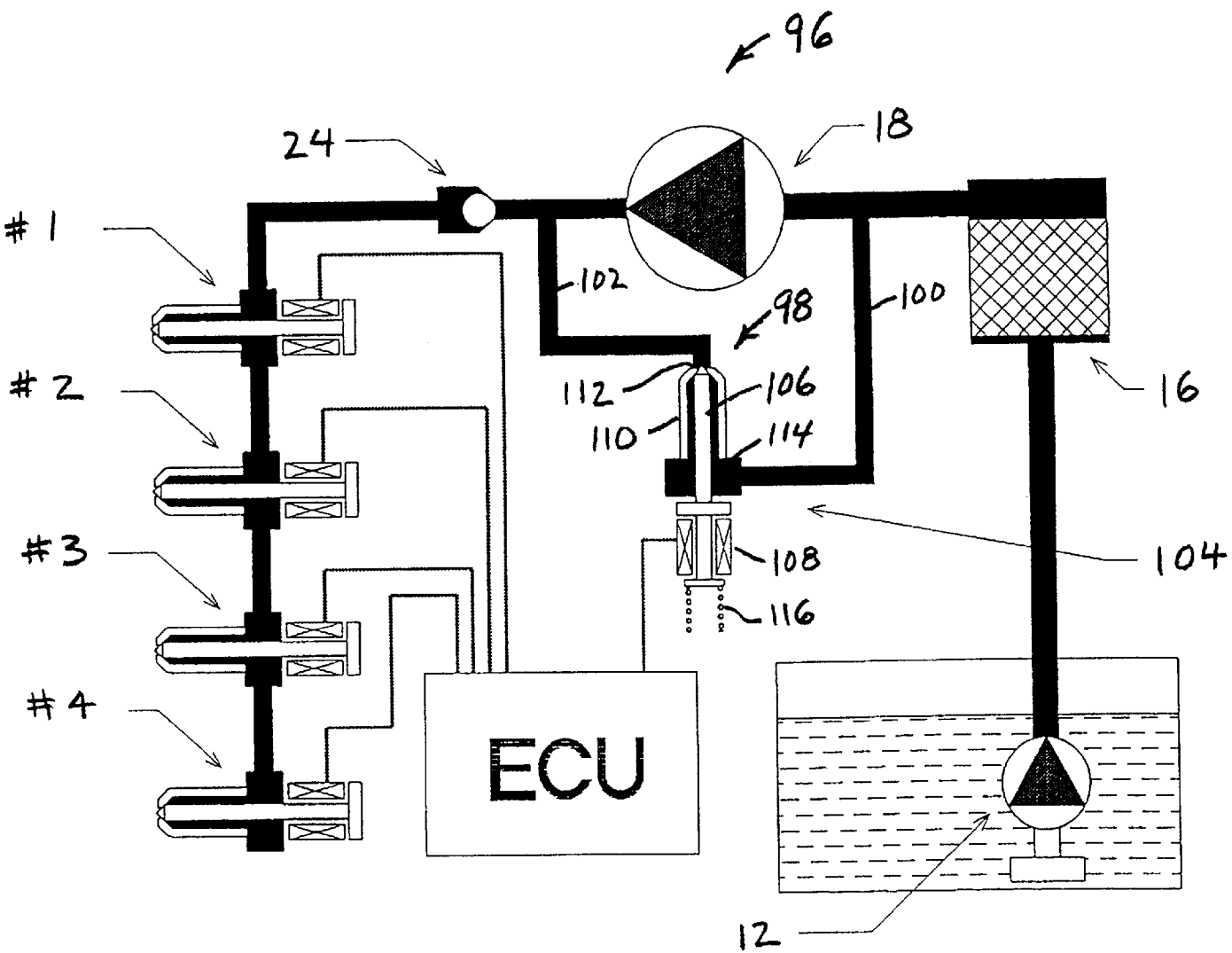
FIG. 8 is a schematic of a third embodiment of a gasoline direct injection system according to the invention.
Figure 9:
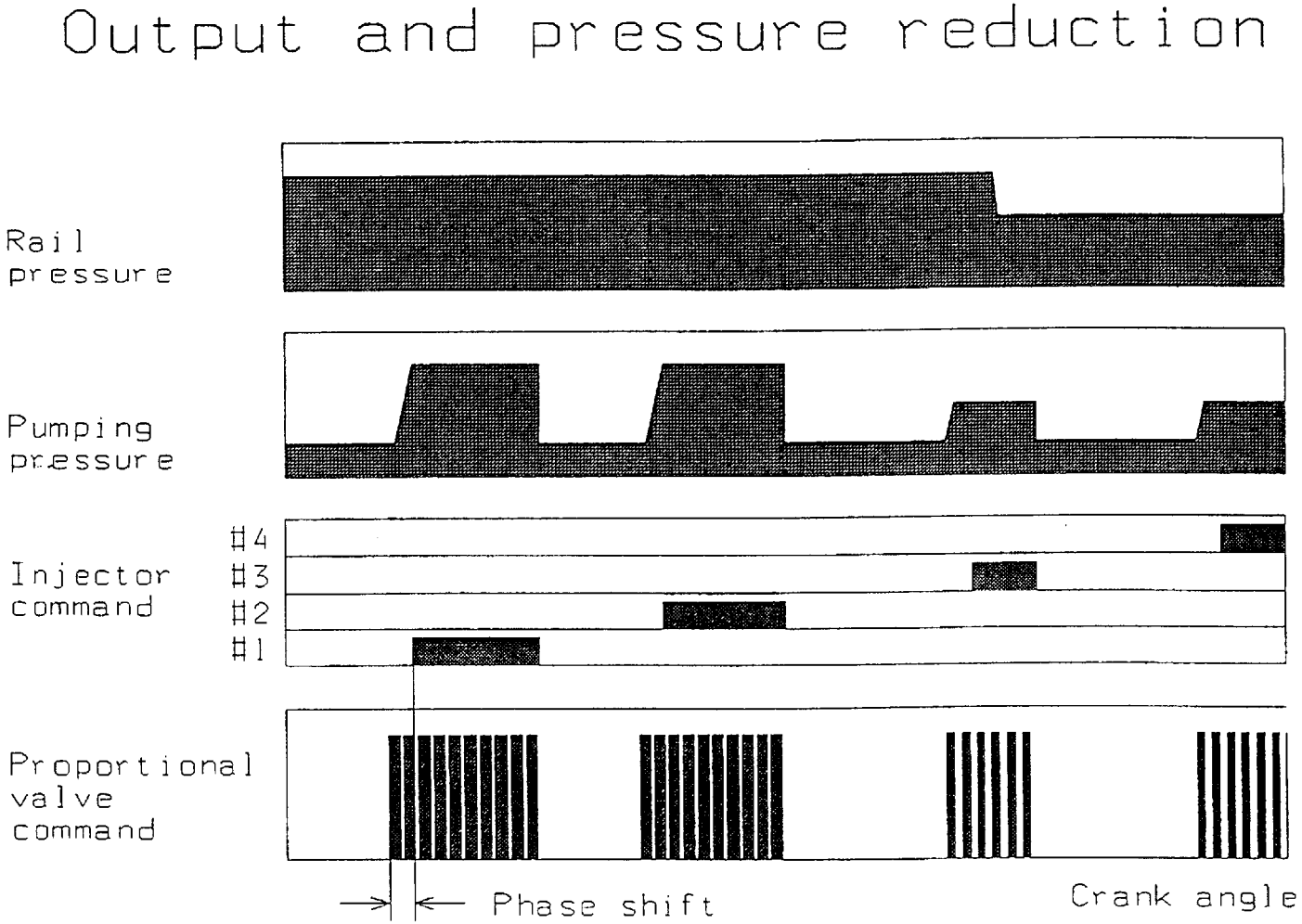
FIG. 9 is a diagrammatic representation of the behavior of the rail pressure, pumping pressure, injector command signal, and proportional control valve signal associated with a third control method, for the system of FIG. 8, according to the invention.
Figure 10:
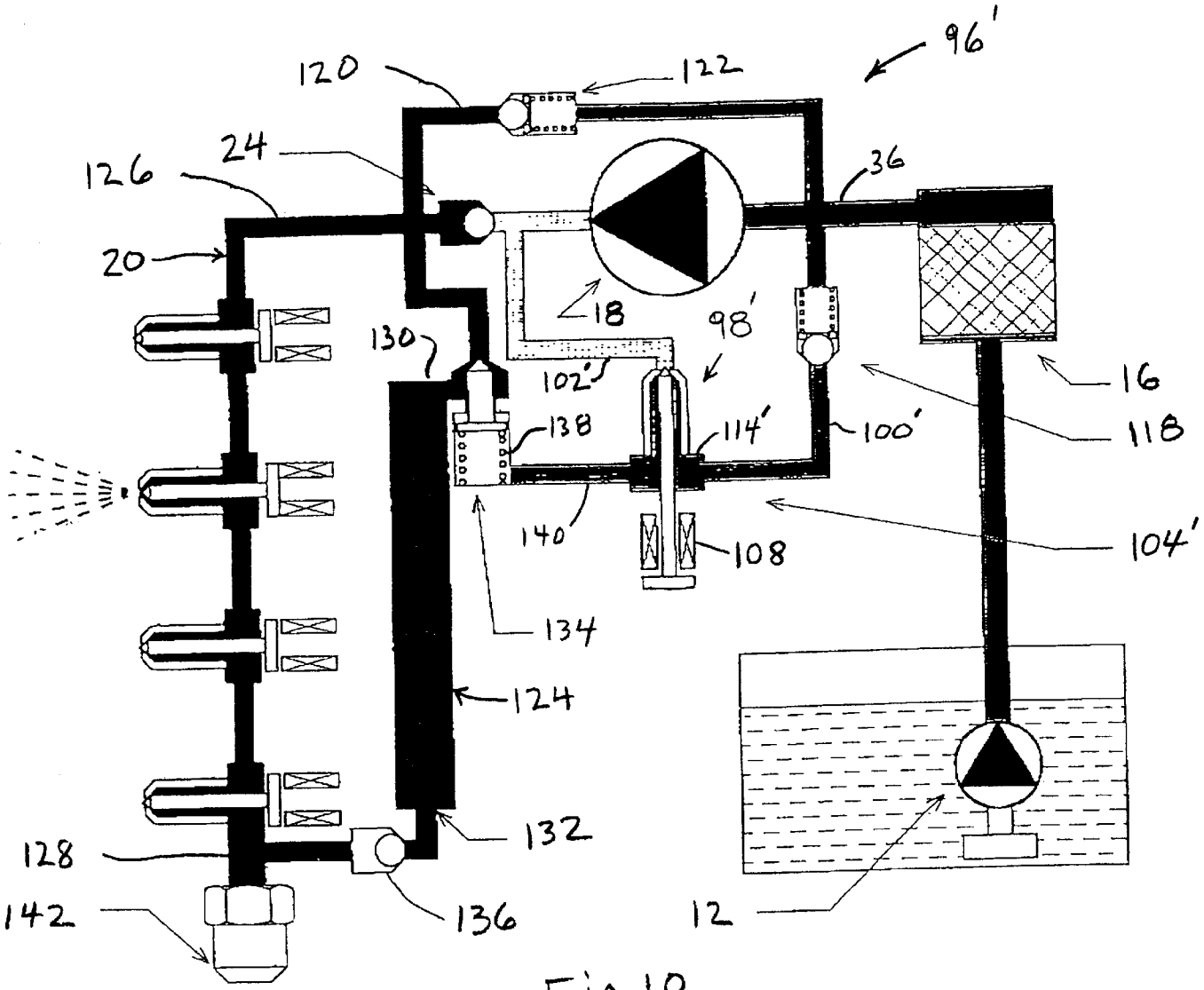
FIG. 10 is a schematic of another, enhanced embodiment of the system shown in FIG. 8.
Figure 11:
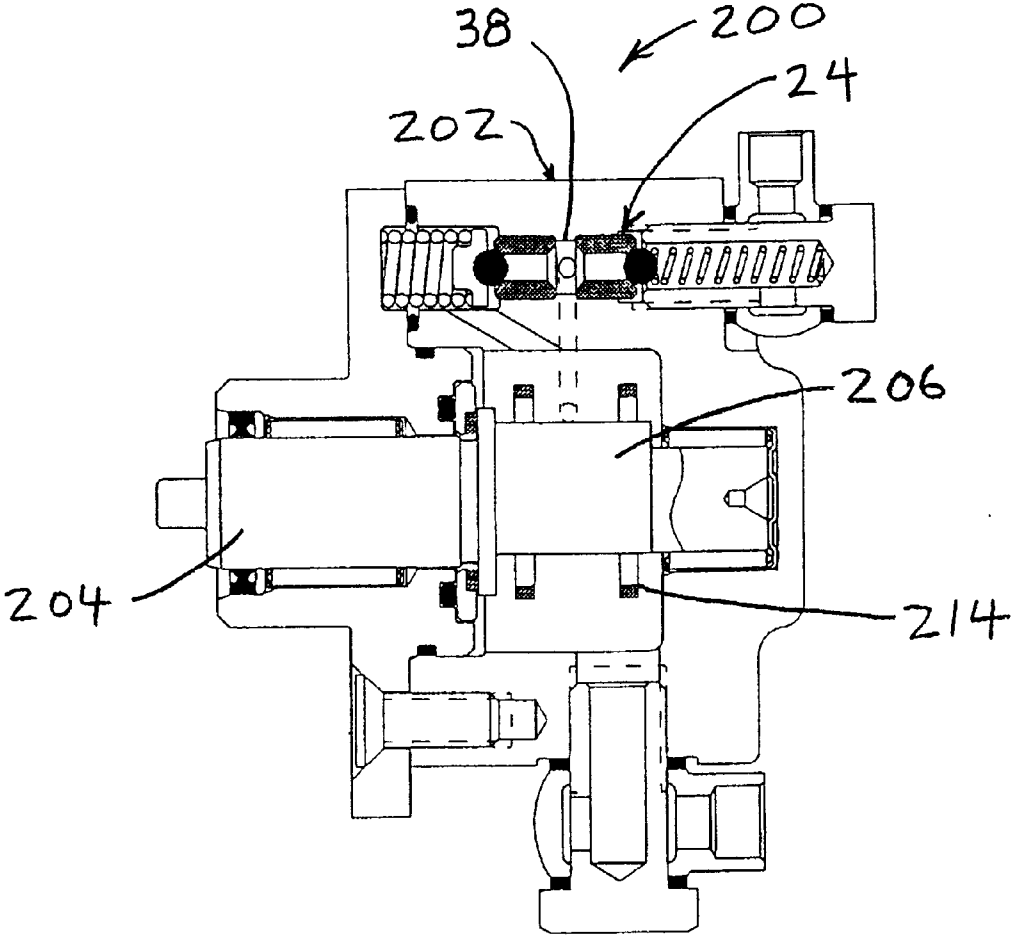
FIG. 11 is simplified, longitudinal section view of a high pressure pump for implementing the system schematic shown in FIG. 8.
Figure 12:
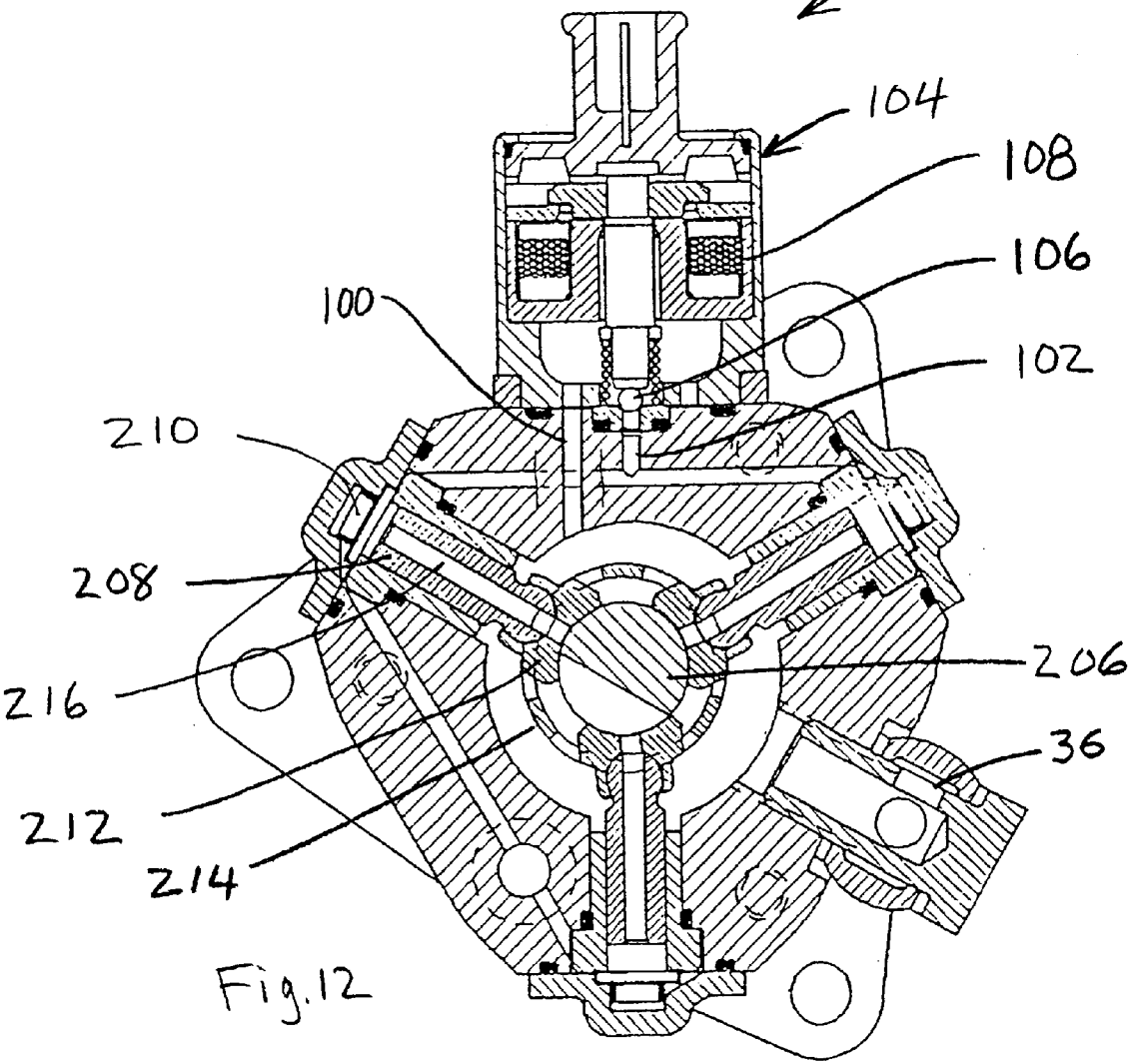
FIG. 12 is a simplified, cross sectional view of the high pressure pump shown in FIG. 11.

A schematic of the preferred embodiments 96 and 96' are shown in FIGS. 8 and 10, and a schematic of the preferred mode of operation is shown in FIG. 9. The primed numeric identifiers in FIG. 10 correspond to the unprimed counterparts in FIG. 8 and only the unprimed will be referred to for convenience. FIGS. 11 and 12 show an example of a hardware implementation, in a configuration similar to that described in U.S. patent application Ser. No. 09/031,859. Only the features of the pump 200 necessary to illustrate the present invention are described herein; the disclosure of that application can be referred to if additional details are desired.

The pump high pressure output timing is controlled directly by a solenoid valve 104. During the solenoid off-time the spring 116 biases the valve needle 106 against the hole 112 and associated seat, restricting flow from discharge control passage 102. This determines the pump pressure between injections. The pressure is preferably maintained at between 10 to 30 bars. This pressure ensures that there are no torque reversals at any given time, and it can also be used for a "limp home" operation of the engine, in case there are problems in the pressure control circuit (faulty pressure transducer, faulty or disconnected pressure control valve etc.). The spring 116 can alternatively be replaced by a spring and ball valve 118 or the like, for biasing the valve member against the valve seat with an equivalent preload, as shown in FIG. 10. In this embodiment, a bypass passage 120 fluidly connects the pump inlet passage 36 with the common rail 20 downstream of the non-return check valve 24. Means such as a check valve 122, are provided in the bypass passage 120 for preventing flow therein except when the pressure in the common rail exceeds a maximum permitted limit. This limits the pressure increase in the rail caused by, e.g., mechanical problems or thermal expansion.

The hole 112 of the valve body 110 is exposed to the discharge control passage 102 and the space 114 within the body surrounding the needle member 106 is exposed to the inlet control passage 100. The pressure control solenoid 108 is energized shortly before any of the fuel injectors are actuated, resulting in a very rapid pumping pressure increase. Injection takes place during this high pressure pumping phase. The spring (116, 118) and solenoid forces then define the instantaneous pumping pressure. The effective flow resistance of the hydraulic circuit 98 and therefor the effect on the discharge pressure of the pump, can be controlled for a given duty cycle (valve member stroke) by controlling the frequency and duration of the strokes.

In FIG. 9, the first two valve commands each contain ten equally timed discrete opening and closing strokes over a time interval slightly longer than the respective first two injector commend intervals. The second two valve commands contain six equally timed discrete opening and closing strokes over a time interval slightly longer than the respective second two injector commend intervals. Both the number of closures and the duration of each closure for latter valve commands, are of lesser magnitude than the number of closures and the duration of each closure for latter valve commands. Higher duty cycle means higher pumping pressure and vice versa. The injector commands, the associated pumping discharge pressure to the rail, and the rail pressure can thus be adjusted with considerable flexibility and precision using the preferred control circuit of the present invention.

However, the pressure in the rail will remain more or less constant, because at that time there is no demand for fuel and the non-return check valve separates the rail from the pumping circuit.

All the fuel displaced by the pump is then re-circulated back into the pump housing at the lower pressure level. The pump remains relatively cool even during extended periods of re-circulation. Because all pumping chambers are always fully filled, pressure increase is almost instantaneous.

Despite the constant output variations the pump operation remains very quiet at all speeds.

The pump 200 has a housing 202 (which may consist two or more components such as body and cover, etc.). A drive shaft 204 penetrates the housing and carries an eccentric 206 located in a cavity within the housing. A plurality of radially oriented pumping plungers 208 are connected via sliding shoes 212 and actuating ring 214 for radial reciprocation as the eccentric rotates. Feed fuel at low pressure fills the cavity from inlet passage 36 and is delivered via charging passage 216 within each piston to the high pressure pumping chamber 210. The highly pressurized fuel discharges into passage 38, where it encounters check valve 24. The inlet control passage 100, discharge control passage 102, injector-type control valve 104, valve needle member 106, and solenoid 108 of the hydraulic circuit of FIG. 8 are also evident.

In the embodiment of FIG. 10, a split accumulator 124 for the common rail 20 is additionally featured. The selection of the volume of the accumulator is very critical and it is a result of a compromise between two contradictory requirements. A small accumulator volume provides fast response during transients and also fast pressure build up. This is especially important for systems requiring elevated pressure (30 to 40 bar) at cranking, because of low pump output (versus time) and also because generally the leakage tends to increase at low speed. It is, however, far less critical at any of the normal operational points, because of substantial higher speed (ranging from 850+/−RPM at idle to 6000+ RPM at rated speed). Large accumulator volume reduces pressure fluctuation (both hydraulic noise and pressure drop during fuel withdrawal).

The split accumulator design divides the effective accumulation volume in two portions, separated by two check valves; one no return valve and one valve preset for certain opening pressure, for example 50 bar. The common rail 20 has first and second ends 126, 128 and the fuel injectors are connected thereto between the first and second ends. The accumulator 124 has a first end 130 fluidly connected to the first end of the common rail after the non-return check-valve 24 and a second end 132 fluidly connected to the second end 128 of the common rail. A preloaded check valve 134 preset for a particular opening pressure is situated at the first end 130 of the accumulator to receive flow into the accumulator when opened, and is biased in the closed position toward the first end 126 of the common rail. A no return check valve 136 is situated at the second end 132 of the accumulator, to permit flow out of the accumulator and to close toward the accumulator. The preloaded check valve can be set for an opening pressure above 30 bar, only by spring 138 or as a variable dependent on the pressure in passage 140, which is in fluid communication with the inlet control passage 100'. The preloaded check valve is preferably set for an opening pressure of about 50 bar. A pressure transducer 142 may be connected at the second end 128 of the common rail.

During cranking the engine is driven by the starter motor at, for example, 100 to 200 RPM. Because of substantial amount of fuel used for injection, the pressure will remain below the opening pressure of the valve 134 and all the fuel supplied by the high pressure pump 18 can be injected. This will lead to rapid engine firing and subsequent rapid speed increase. The engine speed will quickly reach at least idle speed (700 to 900 RPM) and this speed can be sustained by injecting only a fraction of the fuel delivered by the pump. The excess fuel will cause the pressure to increase and ultimately the valve 134 will open and because of active area increase (the back side of the valve is vented into the low pressure circuit via passage 140) it will stay open until the engine is shut off again. From that point on, a larger accumulator volume will be available, resulting in reduced pressure fluctuation. During the fuel withdrawal the fuel will be supplied to the smaller portion of the rail 20 from both sides (one portion coming from the pump 18 and the balance coming from the accumulator through the no return check valve 136 (flowing in the reversed direction) providing more uniform pressure signature in the rail.

What is claimed is:

1. A gasoline fuel injection system for an internal combustion engine comprising:

a plurality of injectors for delivering fuel to a respective plurality of engine cylinders;

a common rail conduit in fluid communication with all the injectors for exposing all the injectors to the same supply of high pressure fuel;

means for actuating each injector individually at a selected different time during each cycle of the engine;

a high pressure fuel supply pump having a high pressure discharge passage fluidly connected to the common rail, and a low pressure feed fuel inlet passage;

a discharge pressure control subsystem including, an inlet control passage fluidly connected to the low pressure feed fuel inlet passage, a discharge control passage fluidly connected to the high pressure discharge passage, a non-return check valve in the high pressure discharge passage, between the discharge control passage and the common rail, which opens toward the common rail, a control valve fluidly connected to the inlet control passage and to the discharge control passage, and switch means coordinated with the means for actuating each injector, for controlling the control valve between a substantially closed position for substantially isolating the discharge control passage from the inlet control passage and a substantially open position for exposing the inlet control passage to the discharge control passage.

2. The system of claim 1, wherein the control subsystem includes means for regulating the pressure in the discharge control passage above a predetermined minimum, when the control valve is substantially open.

3. The system of claim 1, further including a bypass passage fluidly connecting the pump inlet passage with the common rail downstream of the non-return check valve; and means in the bypass passage for preventing flow therein except when the pressure in the common rail exceeds a maximum permitted limit.

4. The system of claim 1, wherein the control valve is a proportional solenoid valve.

5. The system of claim 4, wherein the solenoid valve has a hollow body in fluid communication with one of the inlet control passage or the discharge control passage, a hole in the body, a needle valve member shiftable within the body to open or close the hole, and the other of the inlet control passage or the discharge control passage being exposed to said hole.

6. The system of claim 2, wherein the means for regulating the pressure is a check valve in the inlet control passage between the control valve and the pump inlet passage.

7. The system of claim 1, wherein the control valve is a proportional solenoid valve having a hollow body in fluid communication with the inlet control passage, a hole in the body, a needle valve member shiftable within the body to open or close the hole, and the discharge control passage being exposed to said hole; and means are provided for biasing the needle into a closed position with a predetermined opening pressure in the discharge control passage independent of the operation of the solenoid.

8. The system of claim 1, wherein the common rail has first and second ends and the fuel injectors are connected thereto between the first and second ends, further including:

a fuel accumulator having a first end fluidly connected to the first end of the common rail after the non-return check-valve;

a second end fluidly connected to the second end of the common rail;

a preloaded check valve preset for a particular opening pressure situated at the first end of the accumulator to receive flow into the accumulator when opened, and biased in the closed position toward the first end of the common rail; and a no return check valve situated at the second end of the accumulator, to permit flow out of the accumulator and to close toward the accumulator.

9. The system of claim 8, wherein the preload of the check valve is dependent on the pressure in the inlet control passage.

10. The system of claim 8, wherein the preloaded check valve is set for an opening pressure above 30 bar, preferably about 50 bar.

11. A method for controlling the operation of a high pressure common rail direct gasoline injection system for an internal combustion engine with a plurality of fuel injections, comprising:

continuously operating a high pressure fuel pump to receive feed fuel at a low feed pressure and discharge fuel at a high pressure to a check valve which opens to deliver high pressure fuel to the common rail;

sequentially actuating each injector;

after each injector actuation is terminated, substantially opening a hydraulic control circuit upstream of the check valve, whereby the pump discharge flow passes through said control circuit instead of said check valve, at a decreased pressure from said high pressure to a holding pressure between said high pressure and said feed pressure;

while the pump discharge flow passes through said control circuit but immediately before each injector actuation, substantially closing said hydraulic circuit whereby the pump discharge pressure rises from said holding pressure to said high pressure; and actuating an injector when the pump discharge pressure reaches said high pressure.

12. The method of claim 11, wherein said low pressure is less than about 5 bar, said high pressure is greater than about 100 bar, and said holding pressure is in the range of about 10–30 bar.

13. The method of claim 11, wherein said hydraulic circuit includes a valve for substantially opening and closing said control circuit and the valve is controlled by an electronic fuel management control unit that also controls the actuation of each injector.

14. The method of claim of 13, wherein said valve is a proportional valve having a valve seat;

said substantial closing and substantial opening of the valve increases flow resistance and decreases flow resistance, respectively, of the fuel passing through the control circuit along the valve seat; and the flow resistance is controlled by varying at least one of the spacing of the valve member from the valve seat and the frequency of changes in said spacing.

15. The method of claim 14, wherein when said valve is substantially closed, said space is eliminated so that flow resistance is essentially infinite and no flow passes along the seat.

16. The method of claim 14, wherein when said valve is substantially closed, a non-zero minimum space is maintained, providing a higher resistance than the rest of the control circuit but permitting a low flow passing along the seat.

17. The method of claim 14, wherein for the duration of said holding pressure, said valve is substantially open, the spacing is at a maximum, and the valve member is deenergized.

18. The method of claim 14, wherein for the duration of said holding pressure, said valve is substantially open, the spacing is greater than the spacing for the substantially closed condition, but the valve remains energized.

19. The method of claim 14, wherein the control valve begins shifting from the substantially open to the substantially closed condition before actuation of an injector;

the control valve remains in the substantially closed condition during actuation of said injector; and the control valve returns to and remains in the substantially open condition simultaneously with the deactuation of said injector.

20. The method of claim 19, wherein said substantially closed condition is maintained by a series of rapid, discrete, reciprocating shifts of the valve toward and away from the valve seat.

21. The method of claim 11, wherein during steady state operation above idle speed of the engine, the injections are discrete events each beginning on a regular time interval, and each event having the same duration which is no greater than about one-half said regular time interval;

each injection event has a unique holding pressure interval and control valve actuation event associated therewith;

each injection event has a unique high pressure pumping duration associated therewith; and each control valve actuation event and each high pressure pumping duration has a longer duration than the associated injection event.

22. The method of claim 21, wherein the injection event, the control valve actuation, and the high pressure pumping duration, all terminate substantially simultaneously.

23. In a method for controlling a common rail gasoline fuel injection system having a high pressure supply pump to the common rail, the improvement comprising recycling the pump discharge flow through the pump at a pressure lower than the rail pressure, between injection events, and restoring the discharge flow to the common rail immediately before the next injection event.

* * * * *